US005818946A

United States Patent [19]

Walter

[11] Patent Number: 5,818,946

[45] Date of Patent: Oct. 6, 1998

[54] RUGGEDIZED SOLAR CHARGED HEARING AID

[76] Inventor: Dieter Waldemar Walter, 701 Zena Highwoods Rd., Kingston, N.Y. 12401

[21] Appl. No.: 620,888

[22] Filed: Mar. 22, 1996

[51] Int. Cl.[6] ..... H04R 25/00

[52] U.S. Cl. ..... 381/68.4; 381/68.6; 381/69.2; 136/256; 136/291; 181/130

[58] Field of Search ..... 381/68.4, 68–69.2, 381/168, 169, 158, 155, 187, 183; 181/129, 130, 135; 136/206, 256, 291

[56] References Cited

U.S. PATENT DOCUMENTS

| | | | |
|---|---|---|---|
| D. 333,385 | 2/1993 | Schmid | D3/78 |
| 2,769,040 | 10/1956 | Mattia | 381/169 |
| 3,723,962 | 3/1973 | Hotchner | 381/168 |
| 4,113,999 | 9/1978 | Swinehart | 381/168 |
| 4,281,222 | 7/1981 | Nakagawa et al. | 381/155 |
| 4,293,808 | 10/1981 | Varadi et al. | 320/2 |
| 4,424,419 | 1/1984 | Chaput et al. | 381/169 |
| 4,425,481 | 1/1984 | Mansgold et al. | 381/68 |
| 4,539,516 | 9/1985 | Thompson | 320/48 |
| 4,638,125 | 1/1987 | Buettner | 381/68.4 |
| 4,703,161 | 10/1987 | McLean | 200/301 |
| 4,802,228 | 1/1989 | Silverstein et al. | 381/68 |
| 4,887,693 | 12/1989 | Plice | 381/168 |
| 4,920,564 | 4/1990 | Allkins | 379/437 |
| 4,926,398 | 5/1990 | Fincher | 367/172 |
| 4,949,386 | 8/1990 | Hill | 381/188 |
| 5,068,901 | 11/1991 | Carlson | 381/68.6 |
| 5,210,804 | 5/1993 | Schmid | 381/69.2 |
| 5,217,540 | 6/1993 | Ogura | 136/251 |
| 5,253,300 | 10/1993 | Knapp | 381/68.6 |
| 5,282,245 | 1/1994 | Anderson | 381/169 |
| 5,303,305 | 4/1994 | Raimo et al. | 381/68 |
| 5,395,168 | 3/1995 | Leenen | 381/68.6 |
| 5,530,763 | 6/1996 | Aebi | 381/69 |
| 5,575,832 | 11/1996 | Boyd | 95/91 |
| 5,610,494 | 3/1997 | Grosfilley | 320/2 |

FOREIGN PATENT DOCUMENTS

| | | | |
|---|---|---|---|
| 3501448 | 8/1985 | Germany | 381/68 |

*Primary Examiner*—Curtis A. Kuntz
*Assistant Examiner*—Rexford N. Barnie
*Attorney, Agent, or Firm*—Floyd A. Gonzalez

[57] ABSTRACT

A hearing aid having a body member with a window in one side, electronics in the body member including a microphone for converting sound into electrical signals, an amplifier for amplifying the electrical signals, a battery for supplying power to the amplifier, a solar cell for recharging the battery from ambient light, and a socket for receiving a cord connected to a receiver in an ear piece. The amplifier is made up of rugged, reliable parts which are packaged in a protected, shock resistant package. The body member is sealed so that the hearing aid is water tight such that it may be submerged in water without leaking, and may be used in a damp, humid environment with minimal effect on the electronic components of the amplifier. Access ports, which may be sealed, are provided to allow access to the electronics for adjustments to tailor the hearing aid setting to an individual wearer. An acoustic lens is provided for transmitting sound through the body to the microphone within while inhibiting the entry of water.

27 Claims, 4 Drawing Sheets

RUGGEDIZED SOLAR CHARGED HEARING AID

The present invention relates to a battery powered hearing aid in which the batteries are solar charged, and more particularly relate to solar charged hearing aids which are very rugged in that the internal components are mounted in a shock resistant package in a watertight case.

BACKGROUND OF THE INVENTION

Hearing aids are known which are solar powered in that they rely on light to power the hearing aid or to recharge batteries which power the hearing aid.

U.S. Pat. No. 5,210,804 issued May 11, 1993 to Schmid for Solar Powered Hearing Aid and Reenergizer Case discloses an in-the-ear type hearing aid which as a rechargeable storage cell permanently connected and permanently situated within its shell, and a solar cell carried on its back plate for reenergizing the storage cell under average ambient conditions. Also disclosed is a carrying case into which the hearing aid may be placed wherein the hearing aid is exposed to light from an electric lamp for reenergizing the storage cell.

U.S. Pat. No. 5,253,300 issued Oct. 12, 1993 to Knapp for Solar Powered Hearing Aid discloses hearing aids which include rechargeable batteries and having contacts which are accessible from outside the hearing aid. A charging case having solar cells is also disclosed into which the contacts of the hearing aids may be plugged such that the batteries in the hearing aids may be reenergized.

U.S. Pat. No. 5,303,305 issued Apr. 12, 1994 to Raimo et al. for Solar Powered Hearing Aid discloses a hearing aid having a permanent built-in rechargeable storage cell or battery, and a solar cell or other photo call which powers the electronics of the hearing aid and recharges the storage cell. One embodiment of the hearing aid may have its case or shell built into a broach, pendant or other piece of jewelry to be worn on the outside of clothing and exposed to light, with an earpiece cable leading from the case to an earpiece in the ear of the wearer.

SUMMARY OF THE INVENTION

The present invention is a hearing aid that is rugged, inexpensive to fabricate and watertight. The hearing aid of the present invention is particularly valuable in that it is solar charged such that batteries do not have to be replaced for an extended period of time because they may be recharged by placing the hearing aid in a lighted environment, such as sunlight, for a short period of time to recharge the batteries. Once the hearing aid is fabricated and sealed, the resulting hearing aid may go for an extended period of time, months or even years, without need for maintenance other than keeping the exterior clean and free from dirt. The resulting hearing aid is thus very valuable for use in remote areas where batteries are not readily available, and where repair parts and service are not available.

The present invention has a body member having a window in one side, electronics in the body member including a microphone for converting sound into electrical signals, an amplifier for amplifying the electrical signals, a battery for supplying power to the amplifier, a solar cell for recharging the battery from ambient light, and a socket for receiving a cord connected to a receiver in an ear piece. The amplifier is made up of rugged, reliable parts which are packaged in a protected, shock resistant package. The body member is sealed such that the hearing aid is water tight in that is may be submerged in water without leaking, and may be used in a damp, humid environment with minimal effect on the electronic components of the amplifier. The batteries of the hearing aid are sufficient to operate the amplifier for several days without recharging such that the hearing aid may be used during a period of dark or stormy days without recharging. The batteries may be recharged by exposing the solar cell to direct sunlight for a period of about one hour, or longer, depending on the last full charge.

It is thus an object of the present invention to provide a rugged hearing aid which may be recharged by a solar cell being exposed to light.

It is another object of the present invention to provide a hearing aid which is watertight.

It is another object of the present invention to provide an amplifier for a hearing aid in which the gain of the amplifier may be changed incrementally in steps by a multiposition switch.

It is another object of the present invention to provide an amplifier for a hearing aid which is packaged so as to be shock resistant.

It is another object on the present invention to provide an amplifier for a hearing aid in which the components of the amplifier are mounted on a printed circuit board, and in which a ramp is used in the body of the hearing aid to cam the board to flex such that some of the components are moved into contact with the body of the hearing aid to form a shock resistant mounting.

It is another object of the present invention to provide an acoustic lens for use in a hearing aid for allowing sound to enter the hearing aid to be transmitted to a microphone while forming a watertight seal.

It is another object of the present invention to mount a microphone in the body of a hearing aid such that sound is transmitted through the aid into the microphone, while the transmission of sound through the body of the hearing aid and supporting structure of the microphone is minimized.

It is another object of the present invention to provide access holes through the body of a hearing aid to allow adjustment of the amplifier of the hearing aid, which access holes are sealable to provide a watertight seal.

The foregoing and other objects, features and advantages of the invention will be apparent from the following more particular description of the preferred embodiment of the invention as illustrated in the drawings.

DESCRIPTION OF THE PREFERRED EMBODIMENT

Figure 1:
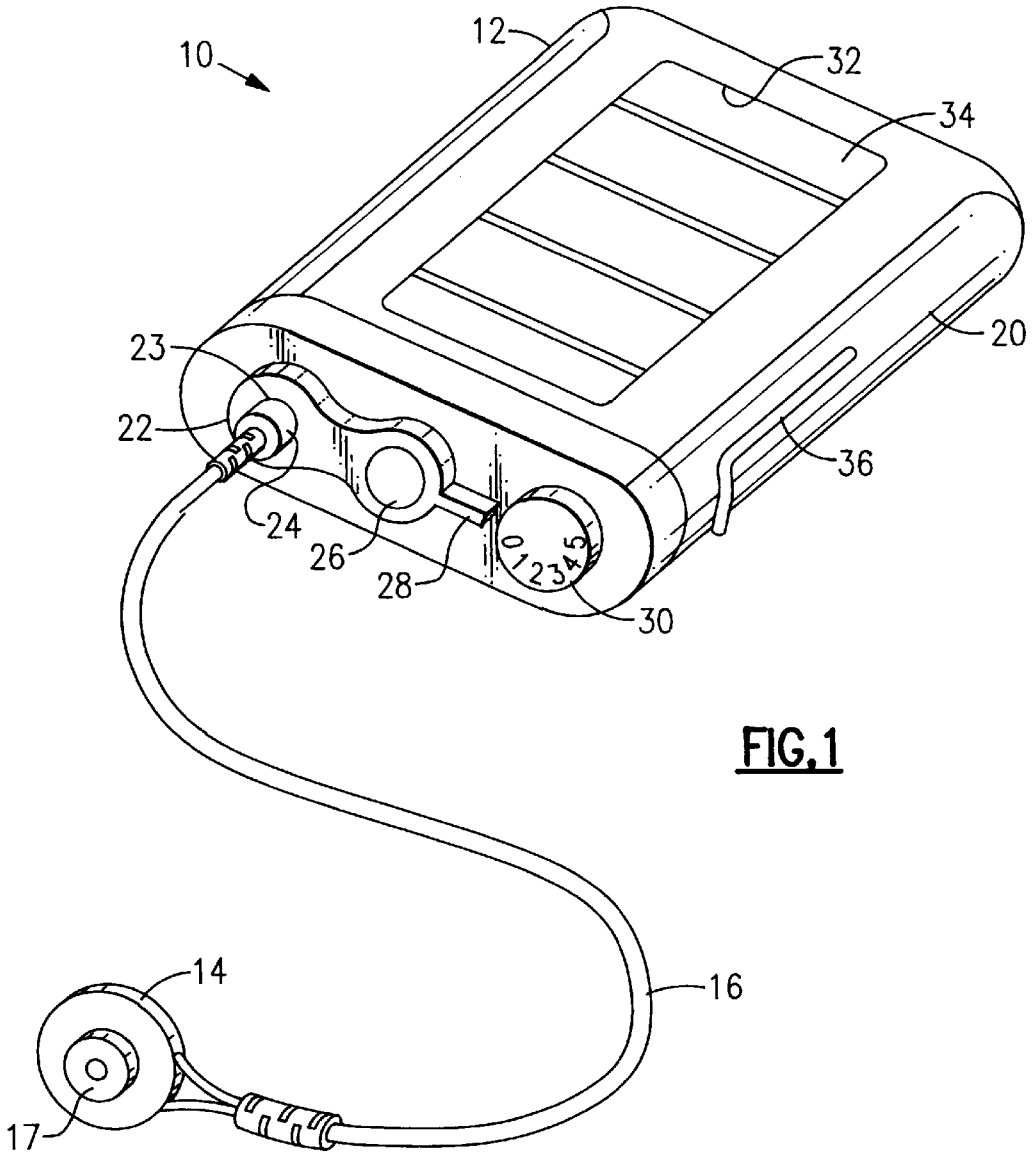
FIG. 1 is a perspective drawing of the hearing aid of the present invention.

FIG. 1 is a perspective drawing of the hearing aid of the present invention 10 having a main body 12 molded from ABS plastic or the like, an earpiece 14, and a wire connector 16 for connecting the earpiece 14 to the main body 12. It will be understood that the earpiece 14 has a connector portion 17 for connection to an earmold (not shown) which is fitted into the ear canal of a hearing impaired wearer in the normal manner. The main body 12 is made up of a header 18 and a lower body portion 20. The header 18 has a molded raised portion 22 having a socket 23 for receiving a three prong connector 24 on the end of the wire connector 16. Formed in the molded raised portion 22, is a sound receiver port 26 to be discussed later. The raised portion 22 also includes a molded pointer 28 which acts as a guide for pointing to indicators on the knob 30 of a volume and power switch, also to be discussed later. The lower body portion 20 is molded in a single piece and has an opening 32 molded therein and covered by a window 100 (see FIG. 4) through which light passes to power a solar cell 34 to recharge batteries 95 and 96 (see FIGS. 3, 4 and 5) which power the hearing aid 10, as will be explained. A wire clip 36 is provided for attaching the hearing aid 10 to clothing, such as a belt, to the wearer.

Figure 2:
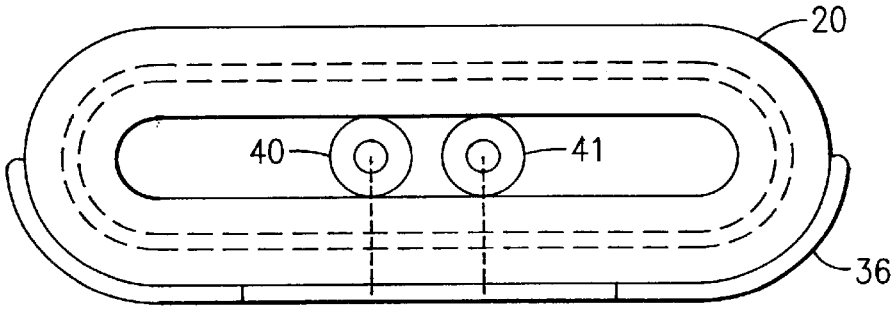
FIG. 2 is a bottom elevational view of the housing of the hearing aid of FIG. 1.

FIG. 2 is an elevational view of the lower body portion 20 of FIG. 1, and shows two access holes 40 and 41 which provide access to controls of the circuitry of the hearing aid 10. One of the access holes provides access to an adjustment for the volume, and the other access hole provides access to an adjustment for the frequency response, to be explained. Once the volume and frequency is adjusted, depending on the needs of the individual wearer, the knob 30 may be turned to change setting in a multiposition switch, each setting giving a discrete step adjustment of the hearing aid gain, as will be explained.

Figure 3:
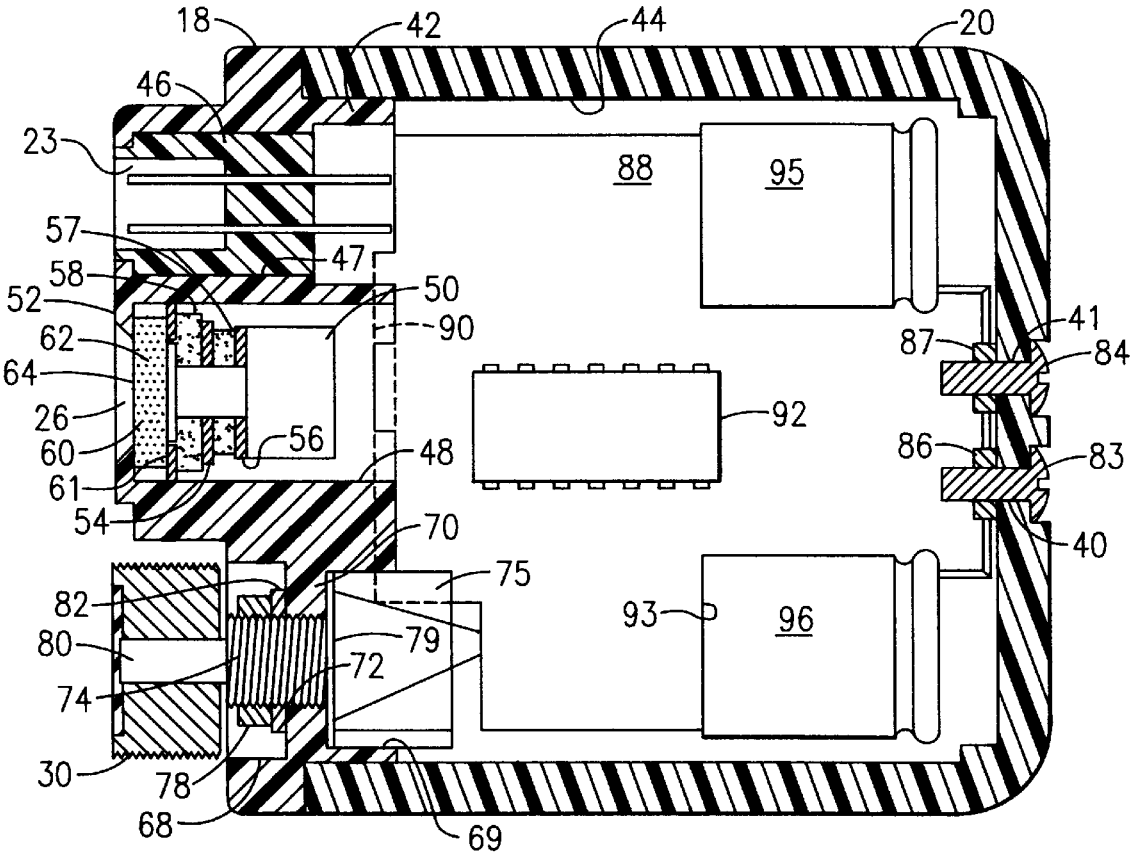
FIG. 3 is a partially sectioned top view of the body of the hearing aid of FIG. 1.

FIG. 3 is a sectional top view of the hearing aid 10 of FIG. 1 showing some of the internal components of the hearing aid 10. The header 18 has a reduced extension 42 which extends into and is in tight engagement with an inner cavity 44 of the lower body portion 20. An appropriate adhesive is applied between the extension 42 and the mouth of the inner cavity 44 for making a watertight seal between the header 18 and the lower body portion 20. A plug 46 having molded in pins is inserted into a cylindrical hole 47 in the header 18. The plug 46 includes the aforementioned socket 23 for receiving the connector 24 of the wire conductor 16 shown in FIG. 1. An appropriate adhesive is used to glue the plug 46 in the hole 47, forming a watertight seal.

Cylindrical hole 48 is provided through the header 18 for receiving a standard electret microphone 50. The end of the cylindrical 48 is bounded by a reduced portion 52 which has the aforementioned port 26 therethrough. The port 26 has tapered sides for directing sound into the microphone 50. The microphone 50 is acoustically isolated from the header 18 by alternating metal washers 54 and 56 with elastomeric foam washers 57 and 58. The stack of washers 54, 56, 57 and 58 are held together and secured to the microphone 50 by a thin layer of adhesive such as RTV silicone rubber. The port 26 is covered by an acoustic lens 60 held in place by a fixed metal washer 61 cemented to the wall of the cylindrical hole 48 through the header 18. In the present embodiment, the acoustic lens is formed of an acoustically transparent non-woven polyester felt 62. The felt 62 is protected from dirt by a soft, elastic membrane 64 in the order of 0.0005 inch thick (0.013 mm). The membrane 64 may be made of either a sheet of polyethylene available from Dow Chemical Company under the tradename "Handi-Wipe" or polyvinylidene chloride avaliable from Dow Chemical Company under the tradename "Saran-Wrap". The membrane 64 may, if desired, be applied to the felt 62 by applying commercially available spray adhesive onto the felt, allowing it to dry slightly before applying the plastic film membrane 64. If the membrane 64 is sprayed with adhesive, the felt 62 and applied membrane 64 are allowed to dry thoroughly, and the composite is stretched to improve the acoustical transparency of the lens 60. The membrane 64 is cemented to the inside of the reduced portion 52 to form a watertight seal. The washer stack is cemented to the metal washer 61 by adhesive such as RTV silicone rubber.

Another preferred embodiment of the acoustic lens 60 is formed by a screen formed from wire cloth woven from wire having a diameter on the order of 0.0001 inch (0.025 mm). This cloth has an open area of around 25 to 40 percent. This provides for transmission of sound, but impedes the passage of water.

It will be understood that this arrangement provides that the microphone is inside the protective envelope of a sealed case without unduly interfering with the passage of sound from the ambient into the microphone, and that the microphone is acoustically isolated from sound vibrations in the solid material of the enclosure itself. The plastic membrane 64 serves as a water and dirt barrier, while the funnel shape of the port 26 in the polymer header 18 minimizes the collection of dirt in the recess. Accumulation of dirt would attenuate the sound passing into the housing 12 through the port 23 to the microphone 50. The funnel shape also facilitates cleaning of the exposed surface of the membrane 64. The disc 62 behind the plastic membrane 64 may be made from any material that is highly transparent acoustically. The disc 62 serves to protect the membrane 64 from rupture or puncture in the event that a fingertip or other relatively blunt object pushes from the outside against the membrane 64, such as during cleaning.

The fixed metal washer 61 cemented to the inside wall of the cylindrical hole 48 serves as a mechanical support for the felt disc 62, and is the mechanical foundation of the isolation washers 54, 56, 57 and 58 between it and the microphone. The isolation washers 54, 56, 57 and 58 are smaller than the bore of the cylindrical hole 48 such that sound must travel through the washer stack from the metal foundation washer 61, and thus be attenuated. Air conduction of sound originating from the outside of the housing 12, having passed through the acoustic lens 60, continues to travel to the microphone 50 through the passage formed by the central openings of the stacked washers 54, 56, 57 and 58; whereas, sound originating on the housing body 12 reaches the microphone 50 only after being greatly attenuated from having to pass from the header 18, through the metal backing washer 61 and the bodies of the stacked washers 54, 56, 57 and 58. The attenuation is greatly enhanced by the elastomeric foam of the washers 57 and 58.

Returning to FIG. 3, counterbores 68 and 69 are provided in the header 18 leaving a wall 70 therebetween. A central bore 72 through the wall 70 is provided such that the bushing 74 of a multiposition switch 75 may pass therethrough. The bushing 74 is threaded and is threadedly engaged with a nut 78 in the bore 68 to hold the switch 75 in place. The previously mentioned knob 30 is fixed to the shaft 80 of the switch such that it may be turned to change the multiposition switch 75 from position to position. The surface of the knob 30 is knurled to make turning easier. The switch 75 may be a commercial switch Grahill series 56 or similar. The switch 75 is watertight in that there are internal o-rings (not shown) between the shaft 80 and the bushing 74 such that water cannot enter the switch 75 between the shaft 80 and the bushing 74. A mechanical lockwasher 82 is provided between the nut 78 and the wall 70, and a washer 79 is provided between the body of the switch 75 and the wall 70 to complete the watertight seal around the switch 75.

Screws 83 and 84 are provided to seal the access holes 40 and 41, respectively. The screws 83 and 84 are screwed into nuts 86 and 87 which are cemented on the interior of the lower portion of the housing 20 as shown. In another embodiment, the screws 83 and 84 may be self tapping screws which are screwed into the access holes 40 and 41 to make a watertight seal. In a further embodiment, a prethreaded metal insert may be molded into the access holes 40 and 41 into which the screws 83 and 84 are threaded to make a watertight seal.

It will thus be understood that the housing 12, when fully assembled, is watertight to the extent that the hearing aid body may be immersed in water to the depth of approximately one and one-half to two feet without leaking. This is especially important since the hearing aid of the present invention is intended to be used in areas where it must be able to withstand rough treatment, and where repair parts are not readily available, and where the hearing aid is expected to be serviceable for several years with little or no care.

Returning to FIG. 3, the center cavity 44 of the body 12 includes a circuit board 88 for holding electrical components of the hearing aid amplifier. The circuit board 88 is fitted into a slot 90 in the header 18, and extends into the cavity 44 in tight engagement with the interior of the lower body 20, to be explained. The electrical components include an integrated circuit 92, which is a type LC 552 bipolar module, mounted on the board 88. The circuit board 88 has a pair of cut out portions 93 and 94 in which are located a pair of rechargeable batteries 95 and 96 which are cemented into place by RTV silicone rubber adhesive. Most of the other components mounted on the circuit board 88 are not shown for clarity.

Figure 4:
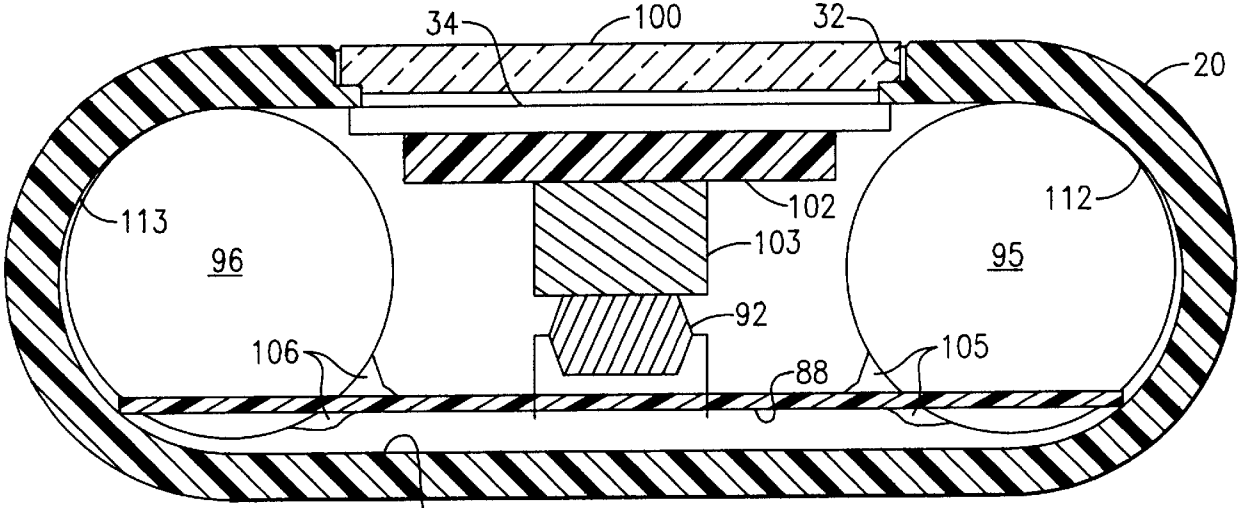
FIG. 4 is a partially sectioned end view of the housing of the hearing aid of FIG. 1.

FIG. 4 is a partially sectioned end view of the lower body portion 20. A clear cast acrylic sheet forms window 100 which is cemented into the opening 32 to form a watertight seal and to allow light to enter the hearing aid body and strike the solar cell 34. A thin spacer 102 formed from a cast acrylic sheet is cemented to the back of the solar cell with RTV silicone rubber adhesive. A thick spacer 103, which may be linen-based phenolic sold under the trade name "Garolite", is cemented under the thin spacer 102 by RTV silicone rubber adhesive. The thick spacer 103 is in-turn cemented to the integrated circuit 92 by cyanoacrylate adhesive. It will be understood that the adhesive and material used for the spacers is not critical, and that many other choices of adhesive and spacer material may be made. The integrated circuit 92 is mounted on the circuit board by solder mounting, in the conventional way. It will be understood that the solar cell 34 is not cemented to the internal wall of the hearing aid body 12, but is centered in the opening 32 and held is place by being cemented to the spacers 102 and 103 which are in turn cemented to the integrated circuit 92, which is mounted to the circuit board 88, as described. The solar cell 34 is a component that needs to be protected from shock because of its construction and the material from which it is made. As mentioned in connection with FIG. 3, batteries 95 and 96 are cemented to the circuit board 88 by RTV rubber adhesive at 105 and 106. The entire circuit board assembly is located in the cavity 44 in the housing 12 of the hearing aid 10, and, as they are cemented together as described, they form a rugged, shock resistant assembly.

Figure 5:
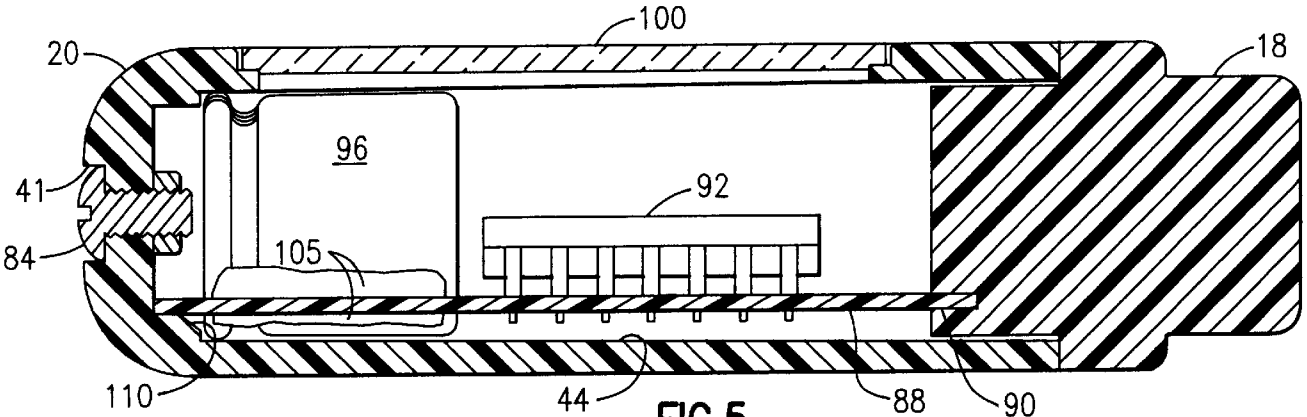
FIG. 5 is partially sectioned view of the right side of the housing of the hearing aid of FIG. 1.

FIG. 5 is a partially sectioned view of the right side of the hearing aid housing 12. The slot 90 in the header 18 into which the circuit board 88 is inserted is shown more clearly. The bottom floor of the cavity 44 in the back of the lower body portion has a ramp 110 which lifts the edge of the circuit board 88 as the circuit board assembly is inserted into its final position in the cavity 44. The external radius of the batteries 95 and 96 is less that the internal radius of the cavity 44. The lifting action caused by the ramp 110 spreads the batteries 95 and 96 such that the batteries are urged into contact with the inner walls 112 and 113 (see FIG. 4) of the cavity 44, and slightly flexes the circuit board 88. The RTV silicone rubber adhesive 105 and 106 is also placed in compression and acts to maintain pressure between the batteries 95 and 96 and the inner wall of the cavity 44 at 112. The resultant force is neither perpendicular or horizontal. It will thus be understood that the action of the ramp 110 on the edge of the circuit board 88 makes the circuit board assembly a rugged, compact, shock resistant assembly. Any shock to the hearing aid body 12 is absorbed or partially absorbed by flexing of the printed circuit board 88. Any deforming pressure which deforms the body 12 of the hearing aid 10 will also be absorbed by the flexing of the circuit board 88. Thus, it will be understood that the shock resistant design of the hearing aid 10 absorbs shocks which can be characterized as sharp blows, as well as shocks that can be characterized as increased external pressure which deforms the body 12.

In another embodiment, the spacer 103 may be made of resilient material for providing a cushion between the solar cell 34 and the integrated circuit 92 to provide shock resistance either in addition to, or in place of, the flexing of the circuit board 88.

Figure 6:
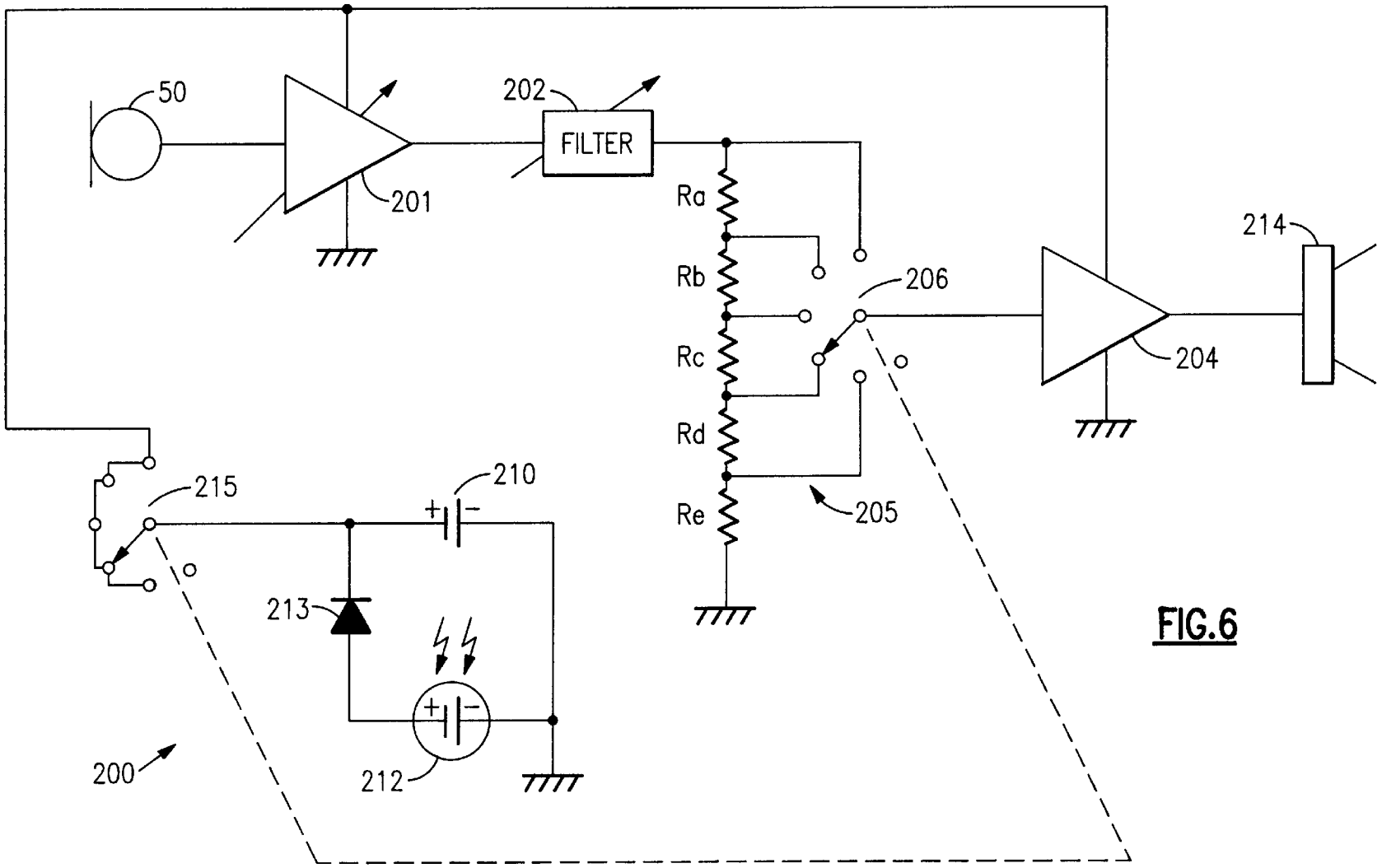
FIG. 6 is schematic diagram of the amplifier circuit of the hearing aid of FIG. 1.

FIG. 6 is a schematic diagram of the amplifier circuit of the hearing aid 10. The amplifier circuit 200 has a preamplifier 201, which is adjustable through one of the access holes 40, 41, and a frequency filter 202, which is adjustable through the other access hole 40, 41.

The switch 75 of FIG. 3 is a 2 pole, 6 throw switch. The first pole, with associated 6 throws, is multiposition switch 206 which adjusts the gain of the hearing aid 10 in incremental steps, as will be explained. The second pole, with associated 6 throws, is multiposition switch 215 which provides an on/off switch, as will be explained.

The circuit 200 further has a power amplifier 204 and a gain adjustment 205 made up of a voltage divider formed by resistors Ra, Rb, Rc, Rd, and Re connected in series to the output of the filter 202, and the multiposition switch 206. Each of the resistors Ra-Re are connected between steps of the multiposition switch 206, and their values are sized to result in a 4 dB±0.2 dB change in gain for each switch position.

Power for the circuit 200 is supplied by battery 210 recharged by solar cell 212 when exposed to light. A diode 213 may be included in the recharging circuit, depending on the solar cell 202 used. The need, or lack thereof, of the diode 213 is well understood by those of ordinary skill in the art, and will not be explained further. The battery 210 is connected to the amplifiers 201 and 204 through the second switch 215 which is ganged to the first switch 206 such that both switches are adjusted simultaneously from position-to-position by the turning of, for instance, a single shaft. All of the secondary contacts of the switch 215 are connected together such that power is supplied to the circuit 200 except in the first position. The first position on both switches 206 and 215 are not connected to act as an on/off switch. The ganged switches 206 and 215 are the switch 75 of FIG. 6, the amplifiers 201 and 204 are in the integrated circuit chip 92, the battery 210 represents the batteries 95 and 96, and the solar cell 212 represents the solar cell 34.

It will be understood the microphone 50 convents the sound received by the microphone 50 into an electrical sound signal which is amplified by the preamplifier 201 whose gain may be adjusted to be appropriate for the wearer. The output of the preamplifier 201 is filtered by a filter circuit 202, whose frequency response is adjusted to pass only desired frequencies tailored for the wearer. The wearer may then adjust the gain adjustment 205, as desired, in approximately 4 dB steps by changing the setting of switch 206. The adjusted sound signal from the gain adjustment 205 will then be amplified by power amplifier 204 and transmitted to the receiver or speaker 214 in the ear of the wearer. The first position of the switches 206, 215 are not connected to the circuit to act as an on/off switch. A multiposition switch 75 is used instead of a potentiometer since it is much more reliable and rugged than an potentiometer. Even though a potentiometer allows for infinite adjustment of the gain, the sliding action of a potentiometer will eventually cause wear, and thus is not as long lived as the preferred multiposition switch.

While we have illustrated and described the preferred embodiment of our invention, it is to be understood that we do not limit ourselves to the precise construction herein disclosed, and the right is reserved to all changes and modifications coming within the scope of the invention as defined in the appended claims.

Having thus described our invention, what we claim as new, and desire to secure by Letters Patent is:

1. A hearing aid comprising:

a body;

an electronic amplifier in said body for amplifying sound;

a microphone in said body in communication with a port for allowing sound into said body, said microphone connected to said amplifier;

an acoustic lens sealing said port, said acoustic lens passing sound coming through said port to said microphone and forming a watertight seal for preventing water from entering said body;

a battery in said body for powering said electronic amplifier;

a solar cell for charging said battery when said solar cell is exposed to light;

access means in the body for allowing access to make adjustments to said electronic amplifier; and means for making a watertight seal sealing said access means;

a watertight window in the side of said body, with said solar cell positioned under said window on the interior of said body for receiving light passing through said window;

a circuit board on which said amplifier is mounted;

spacer means between said amplifier and said solar cell for positioning said solar cell under said watertight window; and securing means for securing said circuit board to said body such that said circuit board is allowed to flex in response to shock transmitted by said spacer means.

2. The hearing aid of claim 1 wherein said access means are access holes molded in the bottom of said body, and said means for making a watertight seal includes screws threaded into said access holes for making a watertight seal.

3. The hearing aid of claim 1 wherein said spacer means is resilient material for providing a cushion between said solar cell and said amplifier.

4. The hearing aid of claim 1 wherein said body includes a central cavity in which is located said shock resistant mount, said cavity defined by walls, said securing means comprising:

board attaching means for attaching one edge of said circuit board to one of the walls defining said central cavity;

battery attaching means for resiliently attaching said battery to said circuit board; and board flexing means for flexing said circuit board and urging said battery attached thereto into engagement to at least a portion of the walls defining said central cavity.

5. The hearing aid of claim 4 wherein said board flexing means is a ramp molded into one wall defining said central cavity at an end of the central cavity opposite said board attaching means.

6. The hearing aid of claim 5 wherein said battery attaching means is RTV rubber adhesive cementing said battery to said circuit board.

7. The hearing aid of claim 1 wherein said acoustic lens is a screen formed from wire cloth having an open area sufficient for transmission of sound while impeding the passage of water.

8. The hearing aid of claim 1 wherein said acoustic lens includes a pad of acoustically transparent non-woven polyester felt covered by a membrane of plastic film which is transparent to sound and impervious to water.

9. The hearing aid of claim 1 further comprising an acoustic isolator between said microphone and said body such that transmission of sound through the body to the microphone will be minimized.

10. The hearing aid of claim 9 wherein said acoustic isolator is a stack of washers, each washer having a central hole in register with said port such that sound entering though side port is transmitted through said central holes in said washers to said microphone, at least one of said stack of washers being elastomeric foam for attenuating sound traveling from the body of the hearing aid through the washers of said stack of washers to said microphone.

11. A hearing aid comprising:

a body;

an electronic amplifier in said body for amplifying sound;

a microphone in said body in communication with a port for allowing sound into said body, said microphone connected to said amplifier;

an acoustic lens sealing said port, said acoustic lens passing sound coming through said port to said microphone and forming a watertight seal for preventing water from entering said body;

a battery in said body for powering said electronic amplifier;

a solar cell for charging said battery when said solar cell is exposed to light;

access means in the body for allowing access to make adjustments to said electronic amplifier; and means for making a watertight seal sealing said access means;

said amplifier comprising:

a variable gain preamplifier connected to the output of said microphone, the gain of said preamplifier being adjustable through said access means;

a frequency filter connected to the output of said preamplifier, the frequency response of said frequency filter being adjustable through said access means;

a power amplifier connected to the output of said frequency filter for amplifying the output of said frequency filter;

a gain adjustment circuit connected to said power amplifier for adjusting the gain of said power amplifier in steps, said gain adjustment circuit including multiple resistors connected in series forming a voltage divider at the input of said power amplifier; and a multiposition switch, each position of said multiposition switch switching more of said multiple resistors thereby changing the voltage at the input of said power amplifier, thereby providing incremental changes of gain of said power amplifier.

12. The hearing aid of claim 11 wherein said multiple resistors are sized to provide steps of about 4 dB±0.2 dB.

13. The hearing aid of claim 11 wherein said multiposition switch is a 2 pole multiple throw switch with one contact of a first pole being free of connections, and all contacts of a second pole but one being connected to supply power to said amplifier such that said 2 pole multiple throw switch provides one position as an on/off switch and the other positions provide gain adjustment having multiple steps.

14. A hearing aid comprising:

a body having a window in one side;

an electronic amplifier in said body for amplifying sound;

a microphone in said body in communication with a port for allowing sound into said body, said microphone connected to said amplifier;

an acoustic lens sealing said port, said acoustic lens passing sound coming through said port to said microphone and forming a watertight seal for preventing water from entering said body;

a battery in said body for powering said electronic amplifier;

a solar cell for charging said battery when said solar cell is exposed to light; and a shock resistant mount for said solar cell in said body, said shock resistant mount comprising:

a circuit board on which said amplifier is mounted;

spacer means between said amplifier and said solar cell for positioning said solar cell under said window; and securing means for securing said circuit board to said body such that said circuit board is allowed to flex in response to shock transmitted by said spacer means.

15. The hearing aid of claim 14 wherein said spacer means is resilient material for providing a cushion between said solar cell and said amplifier.

16. The hearing aid of claim 14 wherein said body includes a central cavity in which is located said shock resistant mount, said cavity defined by walls, said securing means comprising:

board attaching means for attaching one edge of said circuit board to one of the walls defining said central cavity;

battery attaching means for resiliently attaching said battery to said circuit board; and board flexing means for flexing said circuit board and urging said battery attached thereto into engagement to at least a portion of the walls defining said central cavity.

17. The hearing aid of claim 16 wherein said board flexing means is a ramp molded into one wall defining said central cavity at an end of the central cavity opposite said board attaching means.

18. The hearing aid of claim 17 wherein said battery attaching means is RTV rubber adhesive cementing said battery to said circuit board.

19. A hearing aid usable with an earpiece having an electrical cord attached, said earpiece for wearing in the ear of a user, said hearing aid comprising:

a body having a port for allowing sound to enter said body;

an electronic amplifier in said body for amplifying sound;

a battery in said body for powering said electronic amplifier;

a solar cell for charging said battery when said solar cell is exposed to light;

a microphone in said body for receiving said sound entering said body through said port;

an electrical connector in a socket in said body, said electrical connector connected to said amplifier and sealed in said socket forming a watertight seal for providing an electrical connection between said amplifier and the earpiece whose attached electrical cord is pluggable into said electrical connector in said socket, the cord being of sufficient length to allow the earpiece to be worn in the ear of the user such that sound amplified by said amplifier may be reproduced by the earpiece in the ear of the user when the earpiece is worn in the ear of the user; and an acoustic lens covering said port for transmitting sound coming through said port to said microphone, said acoustic lens forming a seal sealing said port for excluding water.

20. The hearing aid of claim 19 wherein said acoustic lens is a screen formed from wire cloth having an open area sufficient for transmission of sound while impeding the passage of water.

21. The hearing aid of claim 20 wherein said acoustic lens includes a pad of acoustically transparent non-woven polyester felt covered by a membrane of plastic film which is transparent to sound and impervious to water.

22. A hearing aid usable with an earpiece having an electrical cord attached, said earpiece for wearing in the ear of a user, said hearing aid comprising:

a body having a port for allowing sound to enter said body;

an electronic amplifier in said body for amplifying sound;

a battery in said body for powering said electronic amplifier;

a solar cell for charging said battery when said solar cell is exposed to light;

a microphone in said body for receiving said sound entering said body through said port;

an electrical connector in a socket in said body, said electrical connector connected to said amplifier and sealed in said socket forming a watertight seal for providing an electrical connection between said amplifier and the earpiece whose attached electrical cord is pluggable into said electrical connector in said socket, the cord being of sufficient length to allow the earpiece to be worn in the ear of the user such that sound amplified by said amplifier may be reproduced by the earpiece in the ear of the user when the earpiece is worn in the ear of the user; and an acoustic isolator between said microphone and said body such that transmission of sound through the body to the microphone will be minimized, said acoustic isolator being a stack of washers, each washer having a central hole in register with said port such that sound entering through said port is transmitted through said central holes in said washers to said microphone, at least one of said stack of washers being elastomeric foam for attenuating sound traveling from the body of the hearing aid through the washers of said stack of washers to said microphone.

23. A hearing aid comprising:

a body having access means for allowing access into said body;

a microphone in said body for converting sound into electrical signals;

a battery in said body;

a solar cell for charging said battery when said solar cell is exposed to light;

a variable gain preamplifier powered by said battery and connected to the output of said microphone, the gain of said preamplifier being adjustable through said access means;

a frequency filter connected to the output of said preamplifier, the frequency response of said frequency filter being adjustable through said access means;

a power amplifier powered by said battery and connected to the output of said frequency filter for amplifying the output of said frequency filter; and a gain adjustment circuit connected to said power amplifier for adjusting the gain of said power amplifier in steps, said gain adjustment circuit including multiple resistors connected in series forming a voltage divider at the input of said power amplifier, and a multiposition switch, each position of said multiposition switch switching more of said multiple resistors thereby changing the voltage at the input of said power amplifier, thereby providing incremental changes of gain of said power amplifier.

24. The hearing aid of claim 23 wherein said multiple resistors are sized to provide steps of about 4 dB±0.2 dB.

25. The hearing aid of claim 24 wherein said multiposition switch is a 2 pole multiple throw switch with one contact of a first pole being free of connections, and all contacts of a second pole but one being connected to supply power to said amplifier such that said 2 pole multiple throw switch provides one position as an on/off switch and the other positions provide gain adjustment having multiple steps.

26. A hearing aid usable with an earpiece having an electrical cord attached, said earpiece for wearing in the ear of a user, said hearing aid comprising:

a body;

an electronic amplifier in said body for amplifying sound;

a microphone in said body in communication with a port for allowing sound into said body, said microphone connected to said amplifier;

an electrical connector in a socket in said body, said electrical connector connected to said amplifier and sealed in said socket forming a watertight seal for providing an electrical connection between said amplifier and the earpiece whose attached electrical cord is pluggable into said electrical connector in said socket, the cord being of sufficient length to allow the earpiece to be worn in the ear of the user such that sound amplified by said amplifier may be reproduced by the earpiece in the ear of the user when the earpiece is worn in the ear of the user;

an acoustic lens sealing said port, said acoustic lens passing sound coming through said port to said microphone and forming a watertight seal for preventing water from entering said body;

a battery in said body for powering said electronic amplifier;

a solar cell for charging said battery when said solar cell is exposed to light;

access means in the body for allowing access to make adjustments to said electronic amplifier; and means for making a watertight seal sealing said access means.

27. A hearing aid usable with an earpiece having an electrical cord attached, said earpiece for wearing in the ear of a user, said hearing aid comprising:

a body;

an electronic amplifier in said body for amplifying sound;

a microphone in said body in communication with a port for allowing sound into said body, said microphone connected to said amplifier;

an electrical connector in a socket in said body, said electrical connector connected to said amplifier and sealed in said socket forming a watertight seal for providing an electrical connection between said amplifier and the earpiece whose attached electrical cord is pluggable into said electrical connector in said socket, the cord being of sufficient length to allow the earpiece to be worn in the ear of the user such that sound amplified by said amplifier may be reproduced by the earpiece in the ear of the user when the earpiece is worn in the ear of the user;

an acoustic lens sealing said port, said acoustic lens passing sound coming through said port to said microphone and forming a watertight seal for preventing water from entering said body;

a battery in said body for powering said electronic amplifier;

a solar cell for charging said battery when said solar cell is exposed to light; and a shock resistant mount for said solar cell in said body.

* * * * *